United States Patent [19]

Von Kohorn

[11] 4,092,634

[45] May 30, 1978

[54] ELECTRIC INDICATOR SYSTEM FOR BALL GAMES

[75] Inventor: Henry Von Kohorn, Greenwich, Conn.

[73] Assignee: John J. Schlager, Springfield, N.J. ; a part interest

[21] Appl. No.: 729,996

[22] Filed: Oct. 6, 1976

[51] Int. Cl.[2] ..... G08B 21/00; A63C 19/06

[52] U.S. Cl. ..... 340/323 R; 273/31; 273/61 B

[58] Field of Search ..... 340/323; 273/31, 61

[56] References Cited

U.S. PATENT DOCUMENTS

| | | | |
|---|---|---|---|
| 3,883,860 | 5/1975 | Von Kohorn | 340/323 |
| 3,982,759 | 9/1976 | Grant | 340/323 |

*Primary Examiner*—Donald J. Yusko

[57] ABSTRACT

An improved electric circuit and indicator system for a court game, such as tennis, using conductive elements on both the ball and outside the court playing area to activate an indicator when the ball drops outside the playing area; wherein said system includes means for deactivating said indicator when the ball contacts one of the playing lines to avoid erroneous indication caused by a skidding ball.

9 Claims, 5 Drawing Figures

ELECTRIC INDICATOR SYSTEM FOR BALL GAMES

BACKGROUND OF THE INVENTION

The present invention relates to an improved electric indicator system for a field or court and ball game, and more particularly to an electric circuit system for determining when struck balls fall outside a field or court, such as a tennis court. It is within the scope of the present invention to utilize the present system in other types of games in which the playing area is within defined boundaries.

As will be hereinafter described, the present invention also represents a specific improvement over that claimed in my earlier issued U.S. Pat. No. 3,883,860 in that it is specifically directed to use on tennis courts having a "skidding" type surface such as clay or wood.

A principal object of the present invention is to provide a system in which players, spectators and umpires are able to determine accurately by visual or audio means, or both, whether or not a ball drops, i.e. hits the ground, outside the designated playing area without having touched any part of the playing area. It is another major object of the present invention to render unnecessary the use of linesmen at tennis matches. A further object of the present invention is to provide an electric indicator and warning system for court games which is relatively easy to install, instantaneous in response, inexpensive to manufacture and will not tend to distract the players while playing the game.

The need for an improved method of determining which tennis balls are "out" and which are still "in play" stems entirely from the difficulty for the human eye of a player, linesman or umpire to infallibly perceive whether a "close" ball is truly an "out ball", or whether the ball has touched the ground inside a line, or whether the ball has touched a line no matter how slightly, and therefore is an "in-bounds" ball and still in play. A person can usually, without danger of error, recognize an "out ball" touching the ground approximately an inch or more outside the line in question. It is a principal object of the present invention, therefore, to ensure that balls touching the ground on the outside of, but in close proximity to a line, xan immediately, automatically and infallibly be identified as being out, thereby terminating the point. It is another principal object of the present invention to prevent identifying a ball which has touched a line, and therefore is still in play, as an "out ball".

The problem of erroneous line "calls" in even the most important matches using experienced linesmen is a serious one. This problem usually arises with respect to either (a) those "out balls" that are very close to a boundary line, i.e. those that touch the ground within approximately one inch from the outside edge of the line, or (b) those close balls that actually remain in play, i.e. those balls that are not actually out, but have touched a line and are erroneously identified as "out balls". It is estimated that elimination of these two types of erroneous "calls", according to the present invention, will prevent more than 95% of the errors that are made. It also is estimated that in a "three out of five set" championship match, there occur less than ten questionable or erroneous "calls" and that the present invention will reduce the number of erroneous cells to 0–1 per match.

My earlier U.S. Pat. No. 3,883,860 pertains to an electric circuit and indicator system for a court game, such as tennis, using conductive elements on both the ball and outside the court playing area to activate a visual and audible indicator when the ball drops outside of the playing area. My earlier patent may enable a better understanding of the present invention and, to the extent necessary, such earlier patent is hereby incorporated by reference. Said patent eliminates by far the largest number of erroneous calls in tennis games played on such surfaces as cement, asphalt, composition, carpet and plastic surfaces made of extruded films or poured rubber and synthetic composites having a rough or textured surface and which do not have any loose sand, powder or other granulated material exposed on the surface.

I have now discovered, however, that the said system of U.S. Pat. No. 3,883,860 is less effective on tennis courts having loosely distributed material on its upper surface such as clay courts and also on tennis courts having very smooth surfaces such as wood. For instance, clay courts, having loosely distributed sand or crushed gravel on their surface, and wood courts, which frequently are lacquered, cause a tennis ball striking the playing surface to skid following the first impact. On clay courts, the length of the skid mark can easily be measured as it is often clearly visible and the overall length of such skid marks measured in the direction of the flight of the ball sometimes is more than four inches. This means that, following the first contact with the ground, the ball skids for a distance which is a multiple of the diameter of the area of first contact between the ball and the ground.

This phenomenon results in possible erroneous indicating by the system described in U.S. Pat. No. 3,883,860 with respect to surfaces which permit some or extensive skidding of the ball. These erroneous "calls" are caused by the ball closing the circuit described in the said U.S. Pat. No. 3,883,860 and activating the indicator after having struck the line which forms part of the playing area (it therefore being an "in ball") and skidding into contact with the conductive strips located outside the line. As a ball having struck any part of the playing area is still in play, the closing of the circuit of U.S. Pat. No. 3,883,860 by such an "in-play" ball, on a clay court would erroneously indicate an "out ball". By means of the present invention, this erroneous indication is avoided.

While the system described in U.S. Pat. No. 3,883,860 is very suitable and efficacious for play on "non-skid" surfaces, it is less so for "skid" surfaces, even though still far superior in results compared to play on courts not equipped with the said system. The present invention reduces the incidence of erroneous "calls" on those surfaces which permit a struck ball to touch a line and then to skid so as to close the electric "out-ball" circuit exterior to said line. While clay or wood courts are cited as examples of "skid courts", some degree of skidding is present on all types of surfaces due to the fibrous nature of the tennis ball surface.

BRIEF DESCRIPTION OF THE INVENTION

The present invention virtually eliminates this kind of error on all types of surfaces by immediately rendering inoperative that open electric circuit which includes the indicator as soon as a ball has touched a line forming part of the "playing area of the moment" (as now to be defined). By "playing area of the moment" is meant that portion of the playing area which is relevant to the progress of the game at the particular moment in question. Thus, it will be apparent to persons familiar with a particular ball game, such as tennis in this instance, that the "in-bounds" playing area changes in accordance with the progress and/or rules of the particular game. Thus, for instance, upon putting a tennis ball in play by "serving" it, the initial playing area, or the "playing area of the moment" is that of the service court, while the subsequent "playing area of the moment" is the singles or doubles court (excluding the service and center lines.)

Towards this end, I provide in the system according to the present invention, two open electric circuits, each capable of being closed by a ball having an electrically conductive surface, comprising a "First Open Circuit" identifying and capable of indicating "in-balls" and a "Second Open Circuit" identifying "out-play balls". The First Open Circuit upon being closed overrides the Second Open Circuit so as to prevent it from falsely signalling the end of a point. The First Open Circuit comprises in addition to a power source and connecting means, two electrically conductive leads or strips, separated by a non-conductive strip. This First Open Circuit is characterized by the fact that one of the electrically conductive strips is a part of, or coincides with, the boundary of the "playing area of the moment" (for instance, a service line or a base line). The other electrically conductive strip may be located on either side of the strip coinciding with the said boundary, but will, according to a preferred embodiment, be located exterior to such boundary.

According to another preferred embodiment of my invention, I utilize a total of three electric leads or strips for both the First and Second Open Circuits. One lead or strip - which will be the innermost in relation to the court boundary and "playing area of the moment" - coincides with the outer portion of the line or tape which visually defines the boundary of the "playing area of the moment". A second electric lead of opposite charge runs parallel to the first lead exterior to said court boundary and spaced approximately ½ inch to 1 inch from said first or innermost lead. A third or outermost lead, having the same electric charge as the first lead and therefore a charge opposite to that of the middle lead, is the one which is farthest removed from the court boundary. It is spaced approximately ½ inch to 1 inch from the second or middle lead. Each lead or strip is approximately ¼ inch to 1 inch wide. The first lead or strip which coincides with the court boundary may be of the same color as the playing surface or the boundary line. The other two strips located exterior to said boundary line may be of any color but, according to a preferred embodiment of my invention, are of a color similar to the color of the surface area exterior to the doubles court.

In addition, according to my invention, I provide a relay or other electric device such as an electromagnetic switch or controls in the First Open Circuit which, upon being closed by the electrically conductive surface of a ball, interrupts the flow of current to the electric indicator in the Second Open Circuit or otherwise immobilizes or renders said indicator inoperative. Thus, the First Open Circuit as soon as closed, overrides the Second Open Circuit and makes it inoperative when closed by the ball a split second later.

Even though the time elapsed between the closing of the First Open Circuit and the closing of the Second Open Circuit is measured in only milliseconds, this is sufficient time to accomplish the stated objective of preventing the indicator in the Second Open Circuit from being activated. Thus, for instance, a tennis ball may actually be in contact with the ground for a distance beginning at, say a base line, and extending to a point 4 inches behind said base line; such a ball, having touched the base line, will be identified by the First Open Circuit as still being "in-play" and the system will not falsely indicate such an "in-play ball" as an "out-ball".

I also provide in the improved system of the present invention means such as an adjustable timing mechanism to reset both circuits so as to be operable after a predetermined period of time which is normally less than sixty seconds after either circuit is closed. As an example, the indicator in the Second Open Circuit may be a bell which starts ringing upon the circuit being closed by an "out-play", thus signalling the end of a point, and stops ringing after two seconds, thus being ready for the next point. Also, as an example, the relay in the First Open Circuit, when activated by an "in-play ball" interrupts the electric current flow to the indicator of the Second Open Circuit for one second and is then ready for the next point.

In accordance with the present invention, the placement of the conductive strips or tapes outside the boundary lines of the court ensures that only out balls will trigger the signal. This has the advantage most important for tennis players, that the indicator be triggered only once; i.e. when the point is over, so that the distraction of a bell or light does not interfere with play.

BRIEF DESCRIPTION OF THE DRAWINGS

The above and other features, objects and advantages of the present invention will be fully understood from the following description considered in connection with the accompanying illustrative drawings in which.

DETAILED DESCRIPTION OF THE INVENTION

Figure 1:
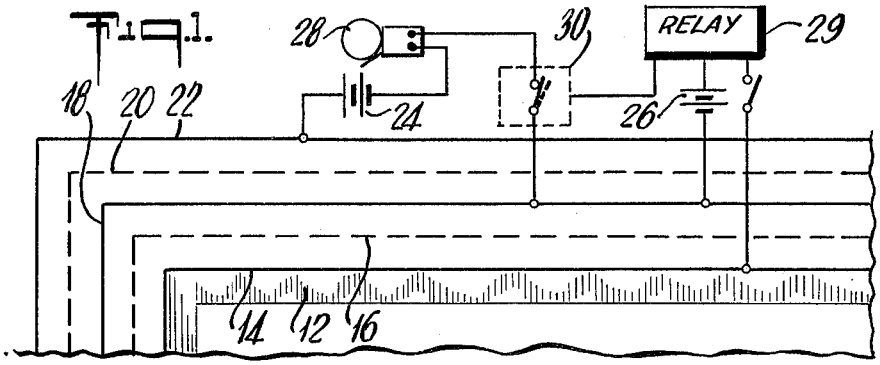
FIG. 1 is a partial diagrammatic representation of an electric indicator circuit for a playing court, including both indicating means and circuit interrupting means.

Referring now to the drawings, there is disclosed in FIG. 1 a conductive band or strip 14, preferably one-half inch in width, the outer edge of which coincides with the outer edge of the visible boundary line 12 of a tennis court. Exterior to conductive strip 14, an insulating band or strip 16 is provided, which is preferably about one-half inch wide and is of a non-conductive nature. Exterior to strip 16 another conductive strip 18 is provided forming a second lead of opposite charge to that of strip 14. This is followed by a second insulating strip 20 and a third conductive strip 22 of opposite charge to middle strip 18. Preferably all strips will be one-half inch in width. It will be observed that strips 14 and 18 in effect provide for a First Open Circuit, and strips 18 and 22 provide for a Second Open Circuit. The circuits are provided with the same or different sources of power, at 24 and 26. Upon the closing of the Second Open Circuit by contact by an "out" ball, an indicator, such as a light or bell will be activated. Such activation will be prevented, however, by closing of the First Open Circuit by an "in-play" ball touching the boundary line at 14 and causing relay 29 to interrupt the current flowing to said indicator 28. This can be readily accomplished by conventional means. For example, an electromagnetic switch (designated generally by box 30) normally in the closed position "A" may be tripped open to position "B" by relay 29 to thereby interrupt the current to indicator 28. Other circuit breaking means can be employed so long as an instantaneous interruption is achieved.

Figure 4:
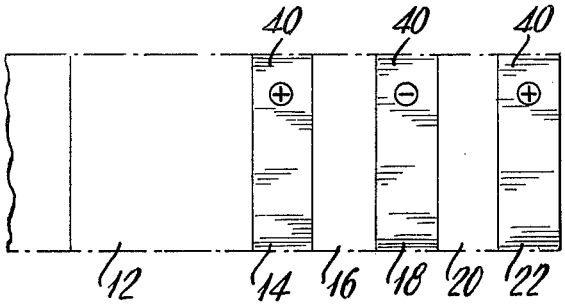
FIG. 4 is top plan view of a portion of a tape comprising the visible boundary line of a tennis court and three separated current conductive strips.

The bands or strips 14–22 may be separate entities or they may form part of a composite tape, as illustrated in FIG. 4 which shows such strips on the upper surface of a tape section. In FIG. 4, the tape width is measured by A–G of which A–C is the visible boundary line, B–C is conductive strip 14 in FIG. 1, C–D is insulating strip 16, D–E is conductive strip 18, etc. As an example, such a tape may consist of non-conductive polyvinyl chloride, preferably with a thickness of one thirty-second of an inch and a total width of one and one-half inches. Such a tape can be metallized by coating, printing, painting, spraying, or any other process on one side along both edges so as to form distinct electrically conductive bands 14, 18 and 22, each preferably one-half inch in width and preferably separated by a one-half inch wide non-conductive bands 16 and 20. Such a tape may be easily installed on existing courts.

An electric power source, e.g. at 24 or 26, applies current to said conductive strips 14, 18 and 22. It is within the scope of this invention to provide more than three conductive strips so long as they are alternately positive and negative, and insulated from each other by intervening non-conductive strips.

Figure 5:
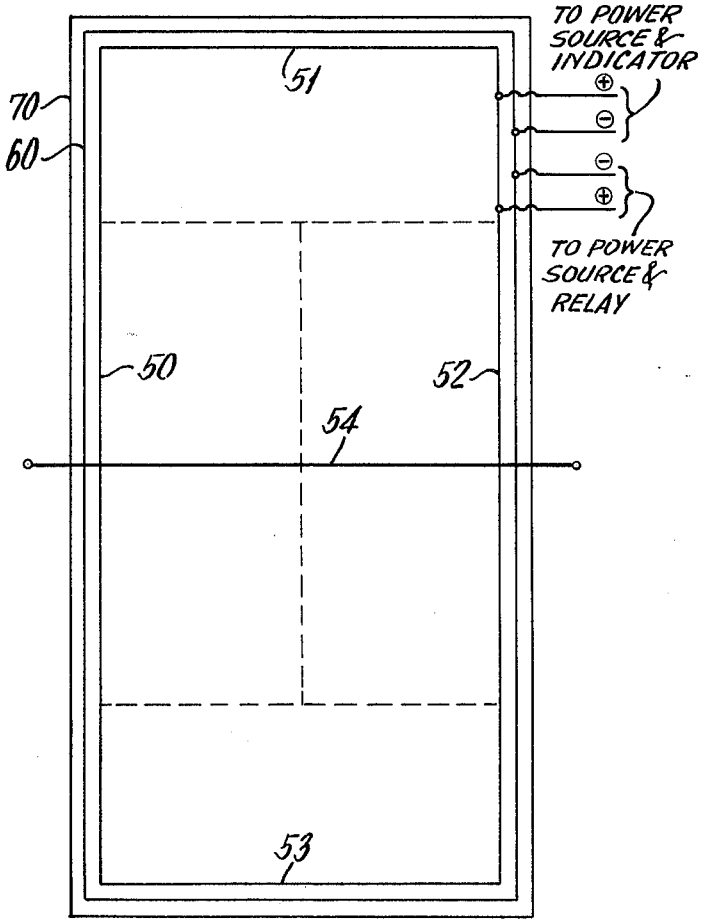
FIG. 5 is a diagrammatic representation of a tennis court wherein "playing area of the moment" is for singles play, said figure showing the service courts and three conductive strips.

For purposes of understanding this specification and drawings a regulation size tennis court and ball will now be described in connection with FIG. 5. The overall area of a tennis court is divided into (1) the "in-bounds" or "playing" area within which a ball must drop in order to be in play following the service, measuring for "singles" (two players) 27 feet by 78 feet and for "doubles" (four players) 36 feet by 78 feet, and (2) the area outside the playing area or "out-of-bounds" area, all of said areas being usually enclosed by a fence or the like. In FIG. 5, lines 50, 51, 52 and 53 define the "singles" playing area. A net 54 essentially 3 feet high is strung laterally across the middle of the court separating opposing players. The following terms are used in the art and in this specification.

Court — the tennis playing area defined by boundary lines within which the ball must drop in order to be in play, e.g. lines 50–53.

Court or "playing area of the moment" — the specific Service Court or the Singles Court, or the Doubles Court within which a ball has to fall in order to be "in-play". The Singles Court of FIG. 5 is defined by lines 50–53.

Singles Lines — the longitudinal lines 50 and 52, perpendicular to the net 54 and defining the Singles Court.

Doubles Lines — the longitudinal lines perpendicular to net 54 (not shown) defining the sides of the Doubles Court.

Base Lines — the lateral lines parallel to net 54 and defining the ends of the Singles (lines 51 and 53) and Doubles (not shown) Court.

Service Lines — the lateral lines parallel to net 54 and 55 and 56 defining the Service Courts.

Center Line — the center line 57 parallel to the Singles Lines (50 and 52) and Doubles Lines (not shown) defining the sides of the Service Courts.

Singles Court — the court defined by the two Singles Lines and the two Base Lines; i.e. 50 and 52, and 51 and 53.

Doubles Court — the court defined by the two Doubles Lines (not shown) and the two Base Lines, 51 and 53.

Service Court — the court (of a total of four) in which the ball being put in play (served) must drop to be "in-play". For example, one Service Court is defined by lines 52, 55, 57 and net 54.

Aisles — the two rectangular areas between the Singles Court and the Doubles Court (not shown).

Far Court — the half of the Singles or Doubles Court farthest from a spectator sitting behind a base line, as shown in the upper half of the diagram of FIG. 5.

Near Court — the half of the Singles or Doubles Court nearest to a spectator sitting behind a base line, as shown in the lower half of the diagram of FIG. 5.

"In-Play" Ball — a ball which has been served and is in play.

"Out-Ball" — a ball dropping outside the Court, i.e. outside a line defining the appropriate Court or "playing area of the moment". Such a ball is not or is no longer, in play.

Activating Lines — connecting the electric leads or strips described herein which form an open circuit and are parallel to (i.e. rectangle 60 and 70) or coincide (i.e. rectangle defined by 50–53) with the visible boundary lines defining a court or "playing area of the moment" to the power source.

First Open Circuit — the elements of an electric circuit formed by a first separate conductive lead or strip coniciding with the boundary line of the "playing area of the moment", as defined by 50, 51, 52 and 53 of FIG. 5; and a second separate conductive lead or strip outside said "playing area of the moment" as defined by rectangle 60; a power source and connecting means; such First Open Circuit being capable of being closed by the electrically conductive surface of a ball touching two neighboring electric leads or strips; e.g. 50 and 60, an electric relay, switch or other control means capable of preventing the indicator in a Second Open Circuit from being activated as soon as the First Open Circuit is closed by an "In Play" ball.

Second Open Circuit — the elements of an electric circuit formed by two or more separate conductive leads or strips located outside the playing area as at 60 and 70 of FIG. 5, a power source, an indicator, connecting means and selective contact means, such an open circuit being capable of being closed by the electrically conductive surface of an "Out Ball" touching two neighboring electric leads or strips.

Point — an exchange of "shots" or hit balls commencing with a service and ending when the ball is no longer in play.

"Non-Skid Surface — court surfaces having such characteristics as to prevent a struck ball, after touching said surface, from significantly skidding on and while in contact with said surface.

"Skid" Surface — court surfaces having such characteristics as to permit a struck ball, after touching said surface, to skid and while in contact with said surface. The surface of the court, including the lines which form part of the court, may consist of any electrically non-conductive material.

In actual practice, therefore, a ball is "In-Play" by means of service into a Service Court, or after service it will be located within the Singles Court or Doubles Court as defined by either the Service Lines, Singles Lines or Doubles Lines, respectively. Service will be made to the Far Court, and as the ball remains In-Play during a Point it will pass over the net alternating between the Near Court and the Far Court. An Out-Ball will drop outside the "playing area of the moment". This may be the Service Court or the Singles Court or the Doubles Court. Such Out-Ball will complete the Second Open Circuit by bridging conductive lines 60 and 70 (FIG. 5) and activate an indicator (bell or light, etc.). However, if the ball first bounces In-Play so as to bridge conductive lines 50 and 60 (FIG. 5) and thereby complete the First Open Circuit, a relay or other device (FIG. 1) will interrupt the current flowing to said indicator thus preventing an erroneous indication.

It will be readily understood that while FIG. 5 demonstrates the invention as applied to the Singles Court, similar provision may readily be made for the Doubles Court, or for any of the four Service Courts. For example, taking the Service Court defined by the boundary lines 52, 54, 57 and 55, the series of three or more conductive strips would be placed around such area in similar fashion to that just described for the Singles Court.

Means for activating either the Singles Court, Doubles Court or any of the Service Courts are described in my previous U.S. Pat. No. 3,883,860, and such means can readily be incorporated into the present invention as will be apparent to those skilled in the art. For example, the Service Court circuits may be subject to separate activation and deactivation independent from the Singles or Doubles Court, so as not to interfere with the subsequent play of a Point.

Regulation tennis balls approved by the United States Lawn Tennis Association are approximately two and one-half inches in diameter. They are hollow, have a flexible wall and an inside air pressure usually above atmospheric pressure. When exposed to outside pressure, such as that resulting from impact, the ball will tend to deform and flatten. A ball hit to the ground thus flattens and leaves a mark, the dimension of which will vary with the severity of the impact. At times, said marks are partial skid marks which tend to distort the true dimensional mark of the ball upon impact. Measurements taken on normal clay tennis courts using approved tennis balls indicate that, depending on its velocity, a ball clearing the 3 foot net leaves a mark, when bouncing, of not less than approximately three-fourths inches, measured in the direction of flight and ignoring skid marks.

As previously described, the surface contact of the ball with the ground causes lead strips 18 and 22 to be electrically connected by means of the current conductive fibers on the surface of the ball. When this occurs, a circuit is closed which in turn activates a visual signalling device and/or an audio signalling device 28, having switch 30.

Figure 2:
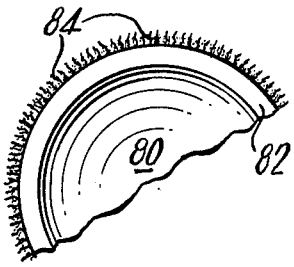
FIG. 2 is a fragmentary elevation view of a ball used in tennis with conductive fibers thereon.
Figure 3:
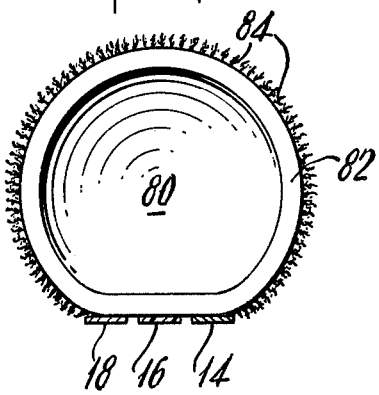
FIG. 3 is an elevation view of the ball of FIG. 2 shown upon impact and contact with the conductive strips forming one of the closed circuits of my electric indicator system for tennis.

Referring to FIG. 2, the ball used in the present game is preferably a tennis ball with hollow center 80 and wall 82, is provided with metallized conductive fibers 84 on the exterior surface thereof. The fibers 84 may be made conductive, for instance, by coating, spraying or otherwise treating them with a current conductive substance. However, it is also within the scope of the present invention to use a ball without a fibrous outer surface. In that case the outer surface of the ball is coated with a current-conductive substance or the cover of the ball may consist of a current conductive material.

Although specific embodiments and examples of my invention have been described above, it is not intended to be limited thereby as additional modifications and alternates will be readily apparent to those skilled in the art. For example, the present invention is readily adaptable to tennis courts which do not use visible boundary lines, such as the systems now employed in "World Team Tennis". In the latter, there are no white boundary lines, but the regulation-size tennis court is divided into colored rectangles defining the forehand and backhand service courts, the backcourt, and the doubles alleys. In applying the present invention to such court the spaced, parallel, current-conductive leads or strip would coincide with the boundary between two adjacent colored rectangles, depending upon the particular "playing area of the moment". Thus, it is to be understood that use of the words "line" or "lines" in this specification and claims refers not only to a distinct, usually white, visible boundary line, but also refers to the edge or boundary of one colored section of the court which abuts an adjacent colored section.

What is claimed is:

1. In an electric out ball indicating system for tennis courts on which a tennis ball has a tendency to skid, an open circuit comprising (a) a power source, (b) an indicator, (c) non-conductive tapes exterior and parallel to the tennis court boundary lines each tape having at least two electric leads comprised of separated, exposed, conductive bands on its upper surface, (d) connecting means between said power source, indicator and conductive bands, wherein said electric leads are so spaced apart that an "out" tennis ball provided with current-conductive surface fibers will be capable of touching two of said electric leads to thereby close said open circuit and activate said indicator, said system further comprising (e) an open circuit comprising a power source and non-conductive tapes generally coinciding at least in part with the tennis court boundary lines, said tapes having at least two electric leads comprised of separated, exposed, conductive bands on their upper surfaces wherein one of said electric leads coincides with a portion of the tennis court boundary lines, said electric leads being so spaced apart that said tennis ball, flattened upon impact, will be capable of touching two of said electric leads, (f) electric means between said power source, indicator and conductive bands forming said open circuit of (e) to interrupt the flow of electric current to said indicator of (b) or to render said electric indicator inoperative, when said ball provided with current conductive surface fibers closes said open circuit of (e) by making contact between the electric leads on the upper surface of said tapes described in (e), whereby an "in-play" ball touching a tennis court boundary line will deactivate said indicator to thereby avoid an erroneous "out-ball" indication caused by skidding of said ball into contact with the electric leads of (c).

2. The system of claim 1 wherein the electric indicator is governed by an adjustable timing mechanism which turns off and resets the indicator after a predetermined period of time.

3. The system of claim 1 wherein the said electric means for rendering the electric indicator inoperative are governed by an adjustable timing device so as to reset said means after a predetermined period of time.

4. An improved electric out ball indicator system for tennis utilizing a court on which a tennis ball has a tendency to skid and comprising, for balls falling outside the boundary lines of the court, (a) a non-conductive playing area defined by court boundary lines, (b) an open electric circuit for detecting "out-balls" formed by parallel, spaced, electrically conductive strips connected to a power source, said strips being located exterior to said court lines, said strips being so spaced apart that said ball will bridge the distance therebetween, (c) an electric indicator capable of being activated when said open circuit of (b) is closed, and further comprising, for balls in-play, (d) an open electric circuit formed by parallel, spaced, electrically conductive strips connected to a power source, at least one of the strips forming said second circuit being located so as to coincide with a portion of the said court lines, said strips being so spaced apart that said ball will bridge the distance therebetween, and further comprising (e) a ball having an electrically conductive surface such that upon contact between an "out-ball" and the strips of the open circuit of (b), said open circuit of (b) is closed, and upon contact by a ball "in-play" with the strips of the open circuit of (d) said open circuit of (d) will be closed, and further comprising (f) electric means integrated into said open circuit of (d) capable of interrupting the flow of electric current to said indicator of (c), or to otherwise render said indicator inoperative, when said open circuit of (d) is closed by said "in-play" ball.

5. The system of claim 4 wherein one electrically conductive strip is common to both of said open circuits and wherein the spacing between two adjacent strips is about one-half to one inch.

6. The system of claim 4 wherein the electric indicator is governed by an adjustable timing mechanism which turns off and resets the indicator after a predetermined period of time.

7. An improved outball indicator system for ball and court games, comprising an open out-ball detecting circuit, an open in-ball detecting circuit, a common power source and an out-ball indicator capable of being activated when the open out-ball circuit is closed, said system being characterized by three electrically conductive strips forming said two open circuits, said three strips being parallel, spaced and insulated from each other, wherein a first strip coincides with the outer edge of the "playing area of the moment" and second and third strips are located exterior to said "playing area of the moment", and wherein said first strip and the second, nearest strip to the first strip, form the in-ball detecting circuit and the second and third strips form the out-ball detecting circuit, said system further comprising a ball having an electrically conductive surface such that a skidding ball flattened upon impact and first touching the first strip, and subsequently touching the second and third strips will first close the in-ball detecting circuit, and electric means integrated into the in-ball detecting circuit, capable, upon closing of said circuit, of interrupting the flow of electric current to the indicator or otherwise rendering said indicator inoperative.

8. An improved out-ball and in-ball detecting system for ball and court games comprising three parallel electrically conductive strips, spaced and insulated from each other, and having a common central strip exterior to the "playing area of the moment", spaced one-half to one inch from the other strips, such as to form an open in-ball detecting circuit with a strip coinciding with the outer edge of the "playing area of the moment", and an open out-ball detecting circuit with the other exterior strip, said system further comprising (a) a common power source for both circuits, (b) an electric out-ball indicator capable of being activated when the out-ball detecting circuit is closed, (c) a ball having an electrically conductive surface such that a skidding ball flattened upon impact with the court surface and first touching the strip coinciding with the outer edge of the "playing area of the moment" and subsequently touching the strips exterior to the "playing area of the moment" will close both of said open circuits, (d) electric means integrated into the circuit comprising the strip coinciding with the outer edge of the "playing area of the moment", capable, upon closing of said circuit, of interrupting the flow of electric current to the indicator or otherwise rendering said indicator inoperative.

9. An improved electric out-ball indicator system for use on tennis courts which consist of colored rectangles representing "playing areas of the moment", comprising, for balls falling outside the "playing area of the moment"

(a) non-conductive, colored, rectangular playing areas having no visible boundary lines, (b) a non-conductive area exterior to the playing areas, (c) an open electric "out-ball" detecting circuit formed by parallel, spaced, electrically conductive strips connected to a power source, said strips being located exterior to and abutting the "playing area of the moment", said strips being of the same color as the surface abutting the "playing area of the moment", (d) an electric indicator capable of being activated when said open circuit of (c) is closed, and further comprising, for balls in play, (e) an open electric circuit for detecting "in-balls", formed by parallel, spaced, electrically conductive strips connected to a power source, at least one of the strips forming said second circuit being located so as to coincide with the outer edge of the colored rectangle being the "playing area of the moment" and being of the same color as the "playing area of the moment" and further comprising, (f) a ball having an electrically conductive surface such that upon contact between an "out-ball" and the strips of the open circuit of (c), said open circuit of (c) will be closed, and upon contact by a ball "in-play" with the strips of the open circuit of (e), said open circuit of (e) will be closed, and further comprising, (g) electric means integrated into said open circuit of (e) capable of interrupting the flow of electric current to said indicator of (d), or to otherwise render said indicator inoperative, when said open circuit of (e) is closed by said "in-play" ball, wherein the "out-ball" and "in-ball" detecting circuits together comprise three electrically conductive strips and wherein the conductive strip of the "out-ball" circuit located closest but exterior to the "playing area of the moment" is common to both said circuits.

* * * * *